US008109608B2

(12) United States Patent
Fannin et al.

(10) Patent No.: US 8,109,608 B2
(45) Date of Patent: Feb. 7, 2012

(54) MICRO-FLUID EJECTION HEAD AND STRESS RELIEVED ORIFICE PLATE THEREFOR

(75) Inventors: Bryan Thomas Fannin, Versailles, KY (US); Vinod Kumar Gopalakrishnan, Berea, KY (US); Christopher John Money, Lexington, KY (US); Sean Terrence Weaver, Union, KY (US)

(73) Assignee: Lexmark International, Inc., Lexington, KY (US)

( * ) Notice: Subject to any disclaimer, the term of this patent is extended or adjusted under 35 U.S.C. 154(b) by 1143 days.

(21) Appl. No.: 11/867,205

(22) Filed: Oct. 4, 2007

(65) Prior Publication Data

US 2009/0091600 A1 Apr. 9, 2009

(51) Int. Cl.

| | |
|---|---|
| ***B41J 2/135*** | (2006.01) |
| ***B41J 2/15*** | (2006.01) |
| ***B28B 1/48*** | (2006.01) |

(52) U.S. Cl. ..... 347/45; 347/47; 264/154

(58) Field of Classification Search ..... 264/156, 264/413; 347/45

See application file for complete search history.

(56) References Cited

U.S. PATENT DOCUMENTS

| | | | | |
|---|---|---|---|---|
| 5,773,553 | A * | 6/1998 | Fuller et al. | 528/170 |
| 7,168,787 | B2 * | 1/2007 | Jung et al. | 347/47 |
| 7,479,203 | B2 * | 1/2009 | Bernard et al. | 156/308.2 |
| 2007/0076053 | A1 * | 4/2007 | Hart et al. | 347/47 |

* cited by examiner

*Primary Examiner* — Omar Rojas

(57) ABSTRACT

A micro-fluid ejection head and methods for improving the fabrication and operation of the micro-fluid ejection head. The ejection head includes a photoimaged thick film layer attached to a substrate containing fluid ejection actuators. An orifice plate is laminated to the thick film layer. The orifice plate has a plurality of concentric orifices therein and is derived from a first photoresist material that is heated to a temperature sufficient to relieve film stresses in the photoresist material prior to exposing and developing the orifices in the orifice plate.

9 Claims, 7 Drawing Sheets

MICRO-FLUID EJECTION HEAD AND STRESS RELIEVED ORIFICE PLATE THEREFOR

TECHNICAL FIELD

The disclosure relates to photoimageable orifice plates for micro-fluid ejection heads and in particular, to improved methods for attaching an orifice plate to a substrate for a micro-fluid ejection head having a thick film layer derived from a radiation curable resin formulation.

BACKGROUND AND SUMMARY

Micro-fluid ejection devices, such as ink jet printers continue to evolve as the technology for ink jet printing continues to improve to provide higher speed, higher quality printers. However, the improvement in speed and quality does not come without a price. As ejection heads become more complex and include more ejection nozzles having smaller diameters, nozzle fabrication tolerances become more critical to the proper performance of the ejection heads.

Techniques for assembling micro-fluid ejection heads typically include applying a nozzle plate or nozzle plate and thick film layer to a substrate containing fluid ejection actuators on a device surface thereof. Manufacturing the parts separately and then assembling the parts to one another was a suitable manufacturing technique for relatively low tolerance, low speed ejection heads. Parts for making higher tolerance ejection heads are desirably assembled to one another before manufacturing for each of the parts is complete. For example, a first photoresist material may be applied to a substrate before it is imaged and developed to provide a thick film layer having flow features therein. Likewise, a nozzle plate made of a second photoresist material may be applied to the thick film layer before nozzles are imaged and developed in the nozzle plate. Use of the foregoing assembly technique may provide more accurate alignment between the flow features and ejection actuators on the device surface of the substrate.

Despite the use of photoimageable materials to provide the flow features in the thick film layer and the nozzles in the nozzle plate, there continues to be a problem with misdirection of fluid droplets ejected from the ejection heads. Accordingly, there continues to be a need for improved micro-fluid ejection heads and assembly techniques that provide a higher yield of usable ejection heads.

With regard to the foregoing exemplary embodiments of the disclosure provide a micro-fluid ejection head and methods for improving the fabrication and operation of the micro-fluid ejection head. The ejection head includes a photoimaged thick film layer attached to a substrate containing fluid ejection actuators. An orifice plate is laminated to the thick film layer. The orifice plate has a plurality of concentric orifices therein and is derived from a first photoresist material that is heated to a temperature sufficient to relieve film stresses in the photoresist material prior to exposing and developing the orifices in the orifice plate.

In another embodiment, there is provided a method for making a micro-fluid ejection head. The method includes applying a first photoresist layer to a device surface of a substrate containing fluid ejection actuators. A plurality of flow features are imaged in the first photoresist layer. The imaged first photoresist layer is then developed to provide a thick film layer including the plurality of flow features therein. A second photoresist layer is applied to the thick film layer. The second photoresist layer has a thickness ranging from about 2 to about 50 microns. Prior to imaging a plurality of nozzle holes in the second photoresist layer, the second photoresist layer is stress relieved. The imaged second photoresist layer is then developed to provide a photoresist nozzle plate on the first photoresist layer.

In yet another embodiment, there is provided a method for improving fluid ejection directionality from nozzles of a micro-fluid ejection head. The method includes applying a nozzle plate material to a thick film layer containing flow features on a substrate that includes fluid ejection actuators. The nozzle plate material is heated to a temperature sufficient to reduce stresses in the nozzle plate material without curing or flowing the nozzle plate material. Nozzles are then imaged and developed in the nozzle plate material.

An advantage of exemplary embodiments described herein is that the nozzles formed after stress relieving the nozzle plate material exhibit improved fluid ejection accuracy than nozzles made by techniques that do not include the stress relieving step. Other benefits of the disclosed embodiments may include improvements in adhesion and durability of the composite substrate and nozzle plate structure, and significant ejection head yield improvement.

For purposes of the disclosure, "difunctional epoxy" means epoxy compounds and materials having only two epoxy functional groups in the molecule. "Multifunctional epoxy" means epoxy compounds and materials having more than two epoxy functional groups in the molecule.

BRIEF DESCRIPTION OF THE DRAWINGS

Further advantages of the exemplary embodiments will become apparent by reference to the detailed description when considered in conjunction with the figures, which are not to scale, wherein like reference numbers indicate like elements through the several views, and wherein.

DETAILED DESCRIPTION OF EXEMPLARY EMBODIMENTS

Figure 1:
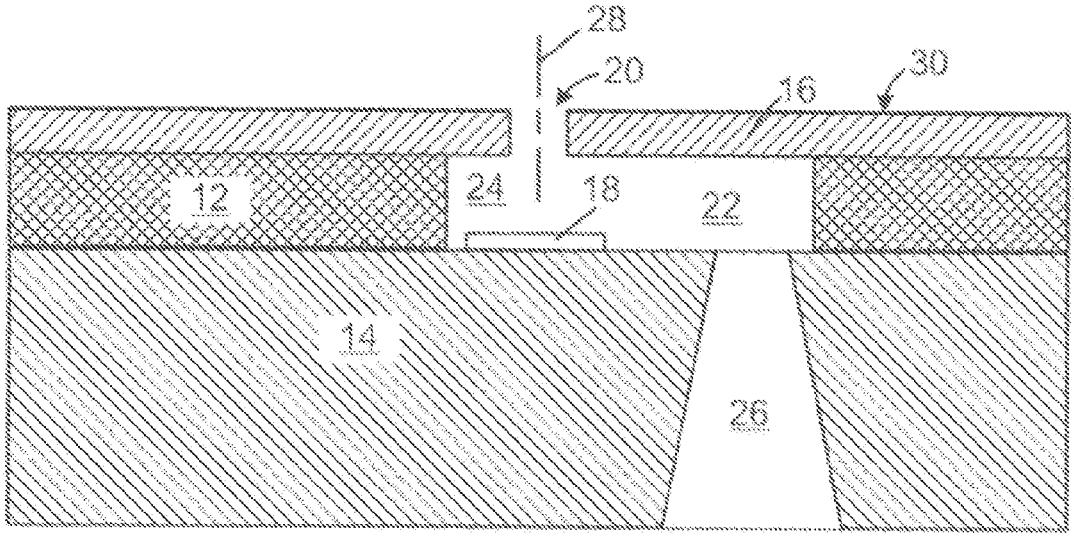
FIG. 1 is a cross-sectional view, not to scale, of a portion of a micro-fluid ejection head.

With reference to FIG. 1, there is illustrated a portion of an ejection head 10 made by combining a first photoresist providing a thick film layer 12 attached to a substrate 14 with a second photoresist material providing a nozzle plate 16. The substrate 14 includes a fluid ejection actuators such as heater resistor 18 associated with each nozzle 20 in the nozzle plate 16.

In order to fabricate such an ejection head 10, a first photoimageable material providing the thick film layer 12 is deposited on a wafer providing the substrate 12. The first photoimageable material is typically spin coated onto the wafer and then is imaged and developed to provide flow features, including a flow channel 22 and a fluid ejection chamber 24 in the thick film layer 12 associated with each ejection actuator 18. A suitable first photoimageable material for providing the thick film layer 12 is described in U.S Publication No. 2007/0076060, the disclosure of which is fully incorporated herein by reference.

Figure 2:
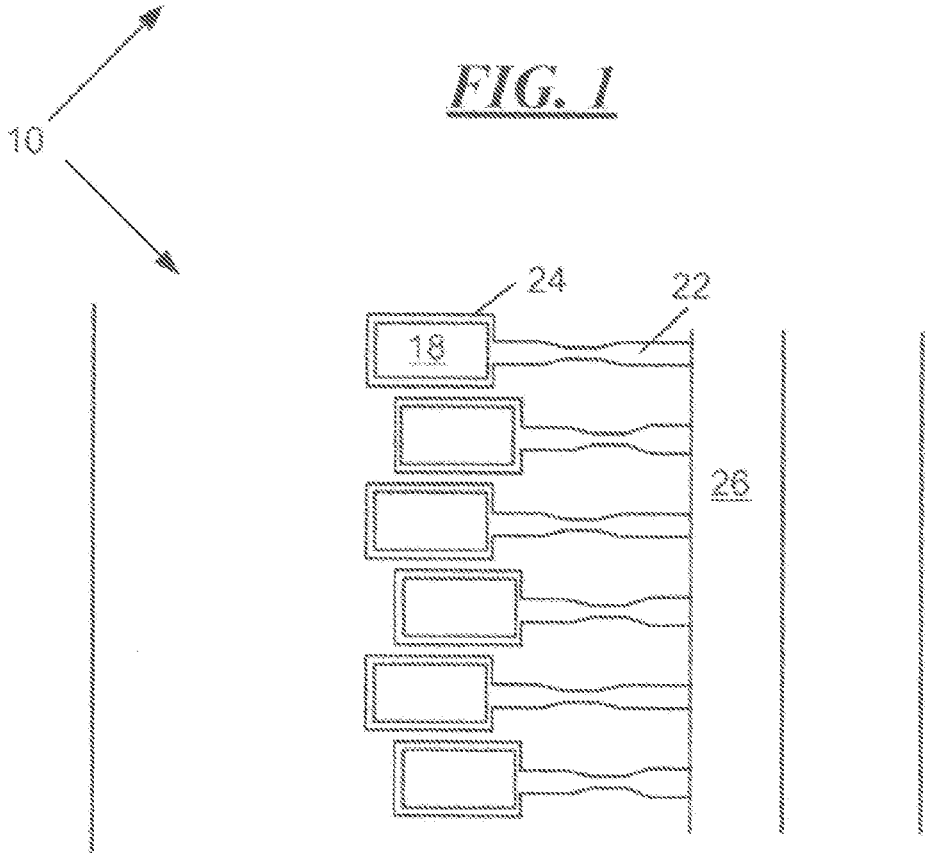
FIG. 2 is a partial plan view of a thick film layer after imaging on a semiconductor substrate.

Fluid is provided to the fluid ejection chamber 24 from a fluid supply to which the substrate 14 is attached through a fluid supply slot 26 formed through the substrate 14. The fluid ejection chamber 24 and fluid flow channel 22 are collectively referred to as "flow features." A plan view of a portion of the micro-fluid ejection head 10 is illustrated in FIG. 2 showing a plurality of ejection actuators 18, fluid ejection chambers 24, fluid channels 22, and the fluid supply slot 26.

After the flow features are imaged and developed in the thick film layer 12, a second photoimageable material providing the nozzle plate 16 is laminated to the thick film layer 12. The second photoimageable material is then patterned with ultraviolet (UV) radiation using a stepper to define the nozzles 20 therein. For a negative photoresist material, areas exposed to UV radiation become insoluble in a developer solvent. After exposing the second photoimageable material to UV radiation, the second photoimageable material may be heated to further cure the areas of the material exposed to the UV radiation. Next the nozzles 20 are developed in the second photoimageable material using an organic solvent to dissolve areas not exposed by UV radiation. The concentricity of the nozzles 20 is critical to proper functioning of the ejection head. Ideally, a fluid directional axis 28 through the nozzle 20 is substantially orthogonal to a plane defined by a surface 30 of the nozzle plate 16.

Figure 3:
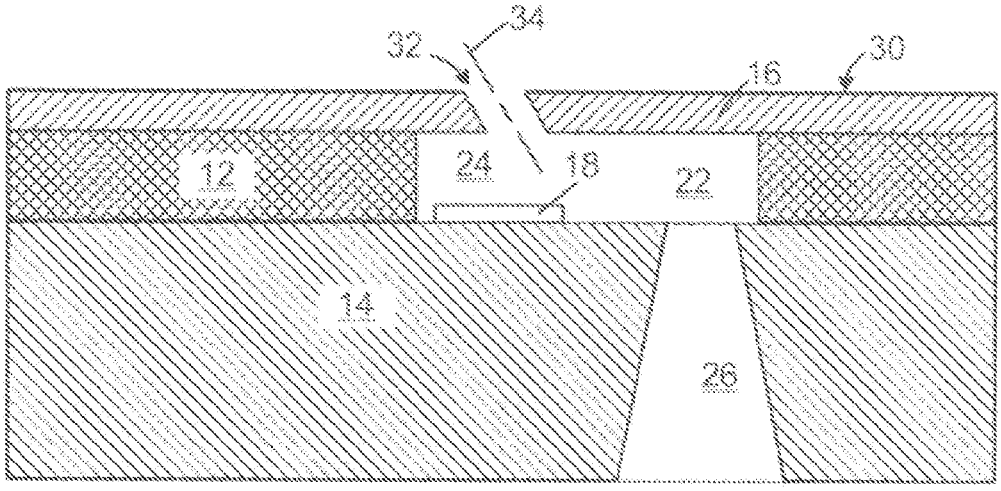
FIG. 3 Prior Art
FIG. 3 is a cross-sectional view, not to scale, of a portion of a prior art micro-fluid ejection head.

The foregoing described process does not always result in nozzles 20 having the orthogonal directional axis 28 as shown in FIG. 1. FIG. 3 illustrates a nozzle 32 having a directional axis 34 that is tilted or angled with respect to the surface 30 of the nozzle plate 16. Such an angled nozzle 32 may result in considerable misdirection of fluid ejected from the nozzle 32. Accordingly, a primary cause of misdirected fluid ejected from a micro-fluid ejection head has been observed to be due to angled nozzles 32.

Without desiring to be bound by theory, it is believed that the angled nozzles 32 may be the result of thermal stresses induced in the nozzle plate 16 during the lamination and/or curing process for the photoimageable material. Accordingly, a process for making a micro-fluid ejection head has been devised wherein a stress relieving step is included prior to imaging and developing the nozzles 20 in the nozzle plate 16. Accordingly, an improved process for fabricating the micro-fluid ejection head 10 is described in more detail below.

According to an exemplary embodiment of the disclosure, the nozzle plate 16 is dry film laminated to the imaged and developed thick film layer 12. The nozzle plate layer has a thickness ranging from about 2 to about 50 microns. A suitable second photoimageable material used to provide the nozzle plate 16 is a dry film photoresist material derived from a first di-functional epoxy compound, optionally, a second di-functional epoxy compound, a relatively high molecular weight polyhydroxy ether, a photoacid generator, and, optionally, an adhesion enhancing agent.

The first di-functional epoxy component may be selected from di-functional epoxy compounds which include diglycidyl ethers of bisphenol-A (e.g. those available under the trade designations "EPON 1007F", "EPON 1007" and "EPON 1009F", available from Shell Chemical Company of Houston, Tex., "DER-331", "DER-332", and "DER-334", available from Dow Chemical Company of Midland, Mich., 3,4-epoxycyclohexylmethyl-3,4-epoxycyclo-hexene carboxylate (e.g. "ERL-4221" available from Union Carbide Corporation of Danbury, Conn., 3,4-epoxy-6-methylcyclohexylmethyl-3,4-epoxy-6-methylcy-clohexene carboxylate (e.g. "ERL-4201" available from Union Carbide Corporation), bis(3,4-epoxy-6-methylcyclohexylmethyl) adipate (e.g. "ERL-4289" available from Union Carbide Corporation), and bis(2,3-epoxycyclopentyl)ether (e.g. "ERL-0400" available from Union Carbide Corporation.

A particularly suitable first di-functional epoxy component for the second photoimageable material is a bisphenol-A/epichlorohydrin epoxy resin available from Shell Chemical Company of Houston, Tex. under the trade name EPON resin 1007F having an epoxide equivalent of greater than about 1000. An "epoxide equivalent" is the number of grams of resin containing 1 gram-equivalent of epoxide. The weight average molecular weight of the di-functional epoxy component is typically above 2500 Daltons, e.g., from about 2800 to about 3500 weight average molecular weight. The amount of the first di-functional epoxy component in a formulation for providing the second photoimageable material may range from about 30 to about 50 percent by weight based on the weight of the cured resin.

In order to enhance the flexibility of the second photoimageable material for lamination purposes, a second di-functional epoxy compound may be included in the formulation for the second photoimageable material. The second di-functional epoxy compound typically has a weight average molecular weight of less than the weight average molecular weight of the first di-functional epoxy compound. In particular, the weight average molecular weight of the second di-functional epoxy compound ranges from about 250 to about 400 Daltons. Substantially equal parts of the first di-functional epoxy compound and the second di-functional epoxy compound are used to make the second photoimageable material. A suitable second di-functional epoxy compound may be selected from diglycidyl ethers of bisphenol-A available from DIC Epoxy Company of Japan under the trade name DIC 850-CRP and from Shell Chemical of Houston, Tex. under the trade name EPON 828. The total amount of di-functional epoxy compound in the formulation for the second photoimageable material may range from about 40 to about 60 percent by weight based on the total weight of the cured nozzle plate 16. Of the total amount of di-functional epoxy compound in the second photoimageable material formulation, about half of the total amount is the first di-functional epoxy compound and about half of the total amount is the second di-functional epoxy compound.

Another component of the second photoimageable material is a relatively high molecular weight polyhydroxy ether compound of the formula:

$$[OC_6H_4C(CH_3)_2C_6H_4OCH_2CH(OH)CH_2]_n$$

having terminal alpha-glycol groups, wherein n is an integer from about 35 to about 100. Such compounds are made from the same raw materials as epoxy resins, but contain no epoxy groups in the compounds. Such compounds are often referred to as phenoxy resins. Examples of suitable relatively high molecular weight phenoxy resins include, but are not limited to, phenoxy resins available from InChem Corporation of Rock Hill, S.C. under the trade names PKHP-200 and PKHJ. Such phenoxy compounds have a solids content of about 99 weight percent, a Brookfield viscosity at 25° C. ranging from about 450 to about 800 centipoise, a weight average molecular weight in Daltons ranging from about 50,000 to about 60,000, a specific gravity, fused at 25° C., of about 1.18, and a glass transition temperature of from about 90° to about 95° C.

Phenoxy resins are particularly useful in making the second photoimageable material partially because they often do not crystallize or build up stress concentrations. Phenoxy resins have high temperature characteristics that enable stability over a wide temperature range including temperatures above about 38° C. The formulation for the second photoimageable material may contain from about 25 to about 35 percent by weight phenoxy resin based on the weight of the cured second photoimageable material.

The formulation for the second photoimageable material also includes a photoacid generator devoid of aryl sulfonium salts. The photoacid generator may be a compound or mixture of compounds capable of generating a cation such as an aromatic complex salt which may be selected from onium salts of a Group VA element, onium salts of a Group VIA element, and aromatic halonium salts. Aromatic complex salts, upon being exposed to ultraviolet radiation or electron beam irradiation, are capable of generating acid moieties which initiate reactions with epoxides. The photoacid generator may be present in the formulation for the second photoimageable material in an amount ranging from about 5 to about 22 weight percent based on the weight of the cured resin.

Of the aromatic complex salts which are suitable for use in exemplary photoresist formulations for the second photoimageable material disclosed herein, suitable salts are di- and triaryl-substituted iodonium salts. Examples of aryl-substituted iodonium complex salt photoacid generates include, but are not limited to:

diphenyliodonium trifluoromethanesulfonate,
(p-tert-butoxyphenyl)phenyliodonium trifluoromethanesulfonate,
diphenyliodonium p-toluenesulfonate,
(p-tert-butoxyphenyl)-phenyliodonium p-toluenesulfonate,
bis(4-tert-butylphenyl)iodonium hexafluorophosphate, and
diphenylidonium hexafluoroantimonate.

The most desirable iodonium salt for use as a photoacid generator for the embodiments described herein is a mixture of diaryliodonium hexafluoroantimonate salts, commercially available from Sartomer Company, Inc. of Exton, Pa. under the trade name SARCAT CD 1012

The formulation for the second photoimageable material may optionally include an effective amount of an adhesion enhancing agent such as a silane compound. Silane compounds that are compatible with the components of the formulation typically have a functional group capable of reacting with at least one member selected from the group consisting of the difunctional epoxy compound, the polyhydroxy ether, and the photoinitiator. Such an adhesion enhancing agent may be a silane with an epoxide functional group such as a glycidoxyalkyltrialkoxysilane, e.g., gamma-glycidoxypropyltrimethoxysilane. When used, the adhesion enhancing agent may be present in an amount ranging from about 0.5 to about 2 weight percent and suitabley from about 0.5 to about 1.0 weight percent based on total weight of the cured resin, including all ranges subsumed therein. Adhesion enhancing agents, as used herein, are defined to mean organic materials soluble in the photoresist composition which assist the film forming and adhesion characteristics of the nozzle plate 16 to the thick film layer 12.

As set forth above, the second photoimageable material is applied as a dry film laminate to the thick film layer 12. Accordingly, the foregoing components of the formulation for the second photoimageable material may be dissolved in a suitable solvent or mixture of solvents and dried on a release liner or other suitable support material. A solvent in which all of the components of the second photoimageable material are soluble is an aliphatic ketone solvent or mixture of solvents. A particularly useful aliphatic ketone solvent is cyclohexanone. Cyclohexanone may be used alone or may be used in combination with acetone. Cyclohexanone is used as the primary solvent for the second photoimageable material composition due to the solubility of the high molecular weight phenoxy resin in cyclohexanone. Acetone is optionally used as a solvent to aid the film formation process. Since acetone is highly volatile solvent it eludes off quickly after the film has been drawn down onto a release liner or support material. Volatilization of the acetone helps solidify the liquid resin into a dry film.

An exemplary formulation for providing the second photoimageable material is as follows:

TABLE 1

| Component | Amount (wt. %) |
|---|---|
| First di-functional epoxy component (EPON 1007F) | 9.6 |
| Second di-functional epoxy component (DIC 850 CRP) | 9.6 |
| Polyhydroxy ether (InChem PKHJ) | 12.8 |
| Diaryliodoniumhexafluoroantimonate (SARCAT 1012) | 7.2 |
| Glycidoxypropyltrimethoxysilane (Z-6040) | 0.3 |
| Cyclohexanone | 50 |
| Acetone | 10.5 |

Figure 4:
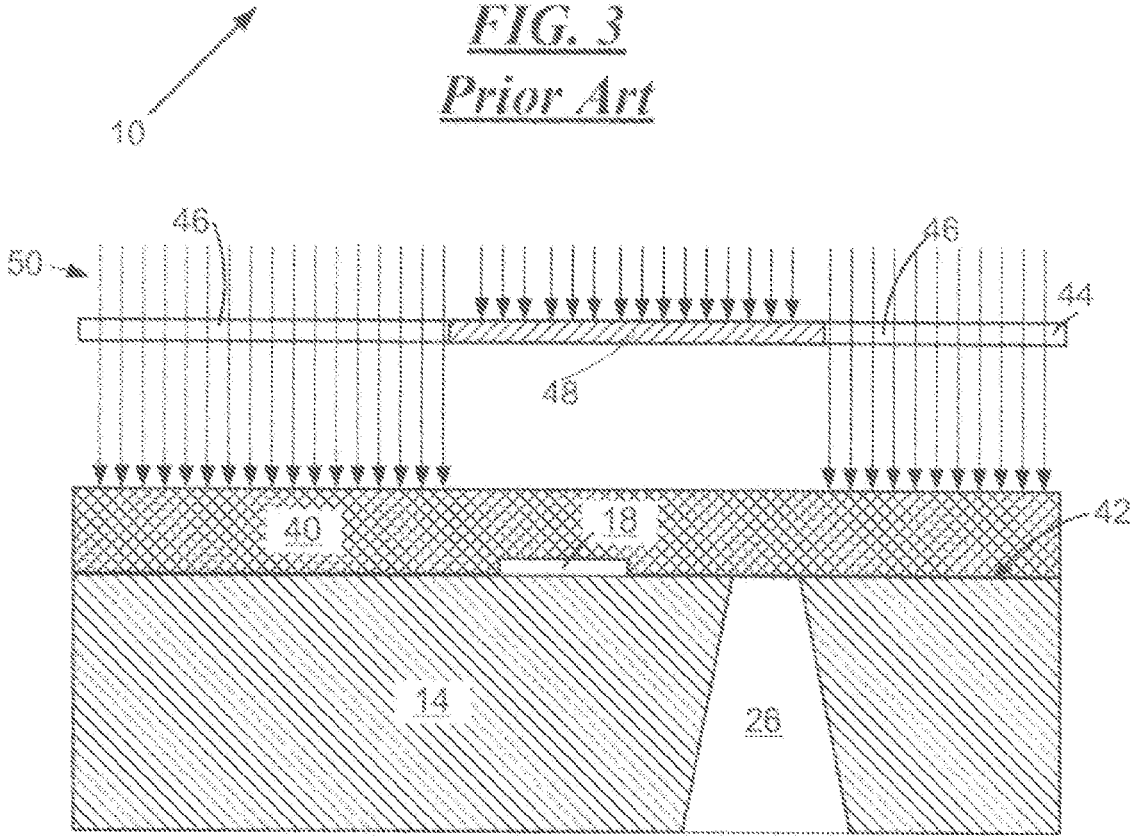
FIGS. 4-8 are schematic views, not to scale, of a process for making a micro-fluid ejection head according to the disclosure.
Figure 5:
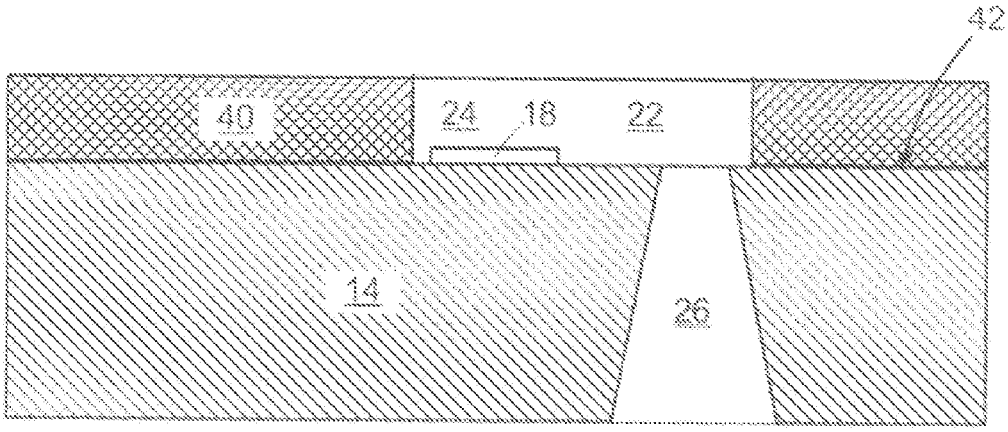
Figure 6:
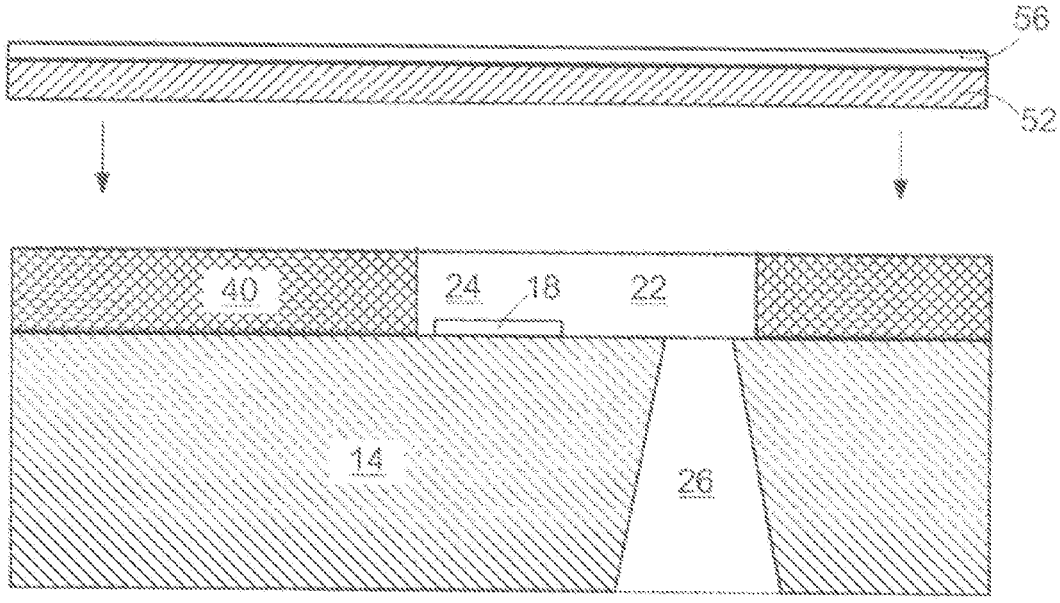

A method for making the micro-fluid ejection head 10, according to exemplary embodiments of the disclosure is illustrated in FIG. 4-6. A first step in making the micro-fluid ejection head 10 is to apply the first photoimageable layer 40, described above, to the substrate 14. In order to apply the first photoimageable material to a device surface 42 of the substrate 14, a substrate wafer may be centered on an appropriate sized chuck of either a resist spinner or conventional wafer resist deposition track. The formulation mixture for the first photoimageable layer 40 is either dispensed by hand or mechanically into a center of the wafer. The chuck holding the wafer is then rotated at a predetermined number of revolutions per minute to evenly spread the mixture from the center of the wafer to the edge of the wafer. The rotational speed of the wafer may be adjusted or the viscosity of the coating mixture may be altered to vary the resulting resin film thickness. Rotational speeds of 2500 rpm or more may be used. The amount of mixture applied to device surface 42 should be sufficient to provide the thick film layer 12 having the desired thickness for flow features imaged therein. Accordingly, the thickness of layer 40 after curing may range from about 10 to about 25 microns or more.

The resulting substrate wafer containing the photoimageable layer 40 is then removed from the chuck either manually or mechanically and placed on either a temperature controlled hotplate or in a temperature controlled oven at a temperature of about 90° C. for about 30 seconds to about 1 minute until the material is "soft" baked. This step removes at least a portion of the solvent from the layer 40 resulting in a partially dried film on the device surface 42 of the substrate 14. The wafer is removed from the heat source and allowed to cool to room temperature.

The layer 40 is then masked with a mask 44 containing substantially transparent areas 46 and substantially opaque areas 48 thereon in order to define the flow features in the photoimageable layer 40 such as the fluid ejection chamber 24 and fluid flow channel 22. Areas of the layer 40 masked by the opaque areas 48 of the mask 44 will be removed upon developing to provide the flow features described above.

In FIG. 4, a radiation source provides actinic radiation indicated by arrows 50 to image the layer 40. A suitable source of radiation emits actinic radiation at a wavelength within the ultraviolet and visible spectral regions. Exposure of the layer 40 may be from less than about 50 milliseconds to 10 minutes or more, suitably about 5 seconds to about one minute, depending upon the amounts of particular epoxy materials and aromatic complex salts being used in the formulation and depending upon the radiation source, distance from the radiation source, and the thickness of the layer 40. The layer 40 may optionally be exposed to electron beam irradiation instead of ultraviolet radiation.

The foregoing procedure is similar to a standard semiconductor lithographic process. The mask 44 is a clear, flat substrate usually glass or quartz with opaque areas 48 defining the areas to be removed from the layer 40 (i.e. a negative acting photoresist material). The opaque areas 48 prevent the ultraviolet light from cross-linking the layer 40 masked beneath it. The exposed areas of the layer 40 provided by the substantially transparent areas 46 of the mask 44 are subsequently baked at a temperature of about 90° C. for about 30 seconds to about 10 minutes, suitably from about 1 to about 5 minutes to complete the curing of the layer 40 in the exposed areas.

The non-imaged areas of the layer 40 are then solubilized by a developer and the solubilized material is removed leaving the imaged and developed layer 40 on the device surface 42 of the substrate 14 as shown in FIG. 5 and in plan view in FIG. 2. During the developing step, the developer comes in contact with the substrate 14 and imaged and cured layer 40 through either immersion and agitation in a tank-like setup or by spraying the developer on the substrate 14 and layer 40. Either spray or immersion will adequately remove the non-imaged material from layer 40. Illustrative developers include, for example, butyl cellosolve acetate, a xylene and butyl cellosolve acetate mixture, and $C_{1-6}$ acetates like butyl acetate.

With reference now to FIG. 6, subsequent to imaging and developing the layer 40, the second photoimageable material, described above, is laminated to the layer 40 to provide nozzle plate layer 52. The layer 52 may be laminated to the layer 40 using heat and pressure. As set forth above, before the layer 52 is imaged and developed, the stress relieving step is desirably used to provide the substantially orthogonal axes 28 for the nozzles 20.

Figure 7:
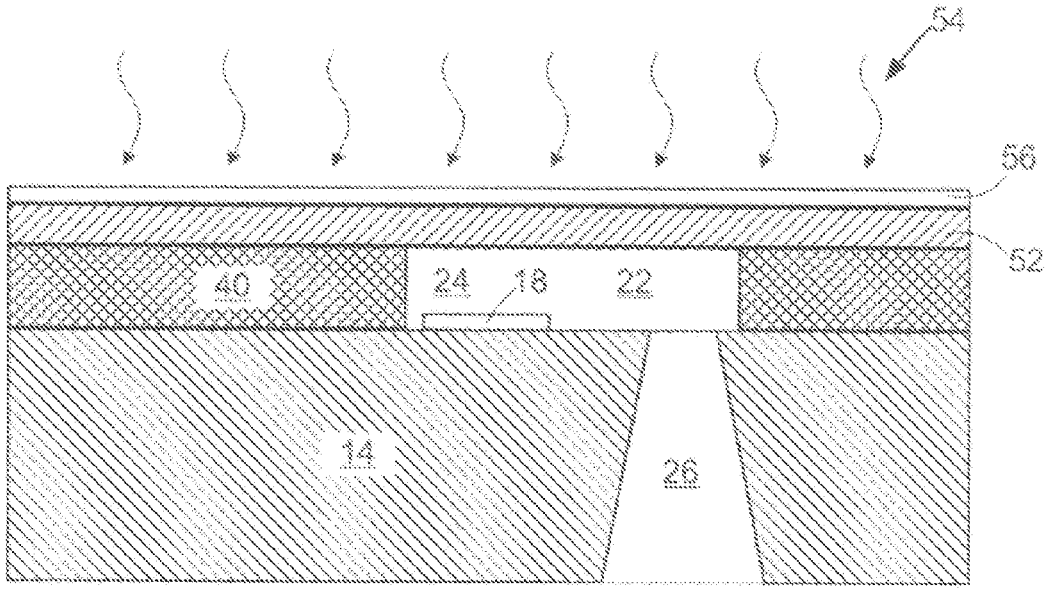

The stress relieving step that may be used is a thermal stress relaxation process that may be achieved by heating the assembled micro-fluid ejection head structure after laminating the second photoresist material to the imaged and developed layer 40 as shown in FIG. 7 wherein arrows 54 indicate the heating step. The thermal stress relaxation process requires a temperature that is sufficient to allow the second photoimageable material to relax the stresses that are inherent as a result of the lamination process used to attach the second photoimageable material to the layer 40.

However, since the material providing layer 52 is substantially uncured after the lamination process and before the image and developing process, the temperature used for the stress relieving step is desirably less than a heat deflection temperature that may cause excessive flow or drooping of the material during the stress relief bake step, since uniform thickness and structural integrity of the nozzle plate 16 is important for the proper operation of the ejection head 10. The uncured second photoimageable material typically has a glass transition temperature ($T_g$) of about 25° C. As set forth above, the layer 52 may also include a release liner 56 made of polyethylene terephthalate with an acrylic silicone release coating thereon. Accordingly, the stress relief bake is suitably conduced at a temperature ranging from about 300 to about 50° C. Bake times may range from about 15 minutes to about 18 hours at the beforementioned temperature. During the stress relief bake step, the release liner 56 desirably remains on the layer 52 to add support to the uncured layer 52 in order to reduce drooping of the material in layer 52 into the flow features of layer 40 during the bake step.

This stress relief bake step may be conducted by placing the substrate 14, layer 40 and layer 52 including liner 56 in an oven or on a hot plate. The primary goal of the bake step is to increase a temperature of the layer 52 sufficient to enable radial stresses to be relaxed in the layer 52 prior to imaging. If the stress relief bake step is not conducted prior to exposing the layer 52 to UV radiation to image the layer 52 for the nozzles 20, the stress relief movement may occur later after the nozzles have been imaged and developed, which may result in the distorted nozzles 32 as shown in FIG. 3. However, by including the stress relieving step prior to imaging and developing the nozzles 20, a dramatic increase in the desired orthogonal orientation of the nozzle axes 28 has been observed.

Figure 8:
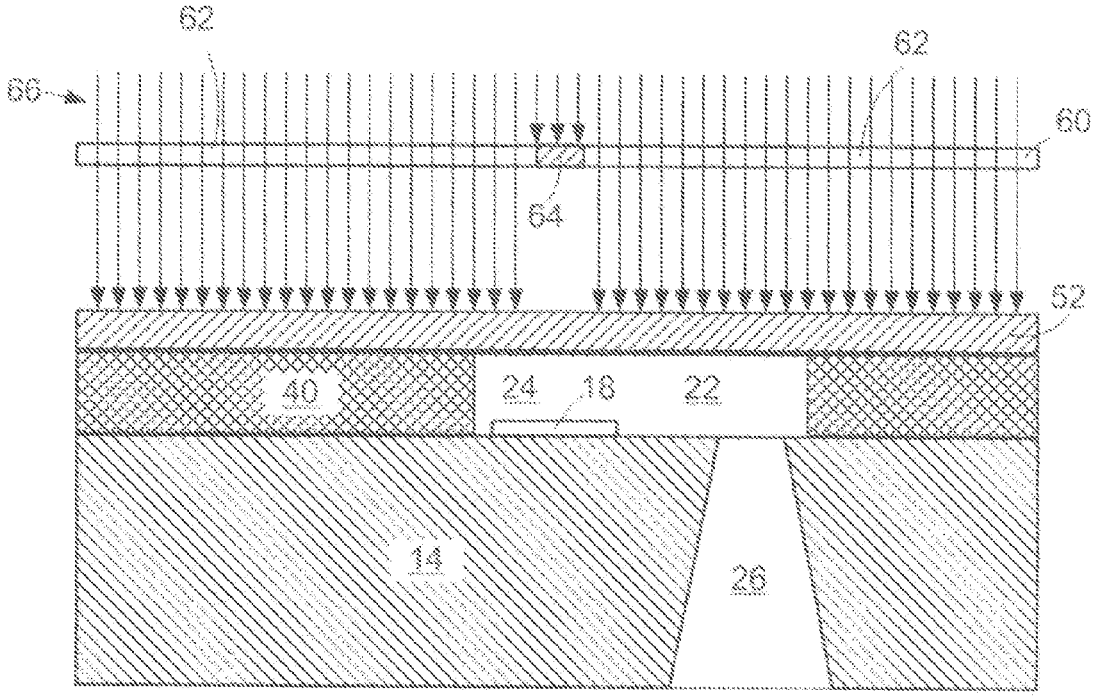

After the stress relieving step, the release liner 56 is removed from the layer 52 and a mask 60 is used to define the nozzles 20 in the second photoimageable layer 52 (FIG. 8). As described above, the mask 60 may include transparent areas 62 and opaque areas 64 defining the nozzles 20 in the layer 52. The opaque areas 64 prevent actinic radiation indicated by arrows 66 from contacting the layer 52 in an area which will provide the nozzles 20, while the remainder of the layer 52 is cured by the actinic radiation. Upon developing the layer 52 with a suitable solvent as described above, the nozzles 20 are formed in the layer as shown in FIG. 1. Conventional photoimaging and developing techniques as described above are use to image and develop the layer 52.

After developing the layer 52, the substrate 14 containing the layer 40 and the layer 52 is optionally baked at temperature ranging from about 150° C. to about 200° C., desirably from about from about 170° C. to about 190° C. for about 1 minute to about 60 minutes, typically from about 15 to about 30 minutes to cure the layers 40 and 52.

Figure 9:
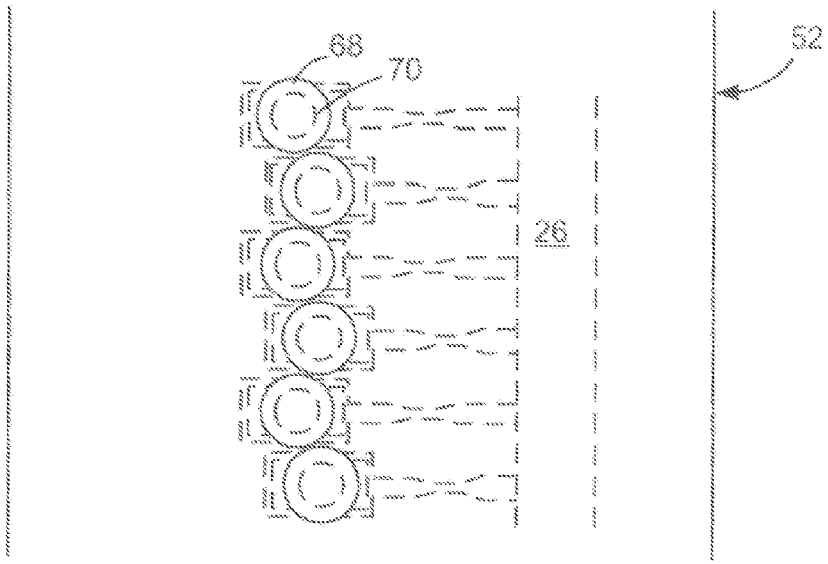
FIGS. 9-10 are schematic views, not to scale, of a portion of an alternative process for making a micro-fluid ejection head according to the disclosure.
Figure 10:
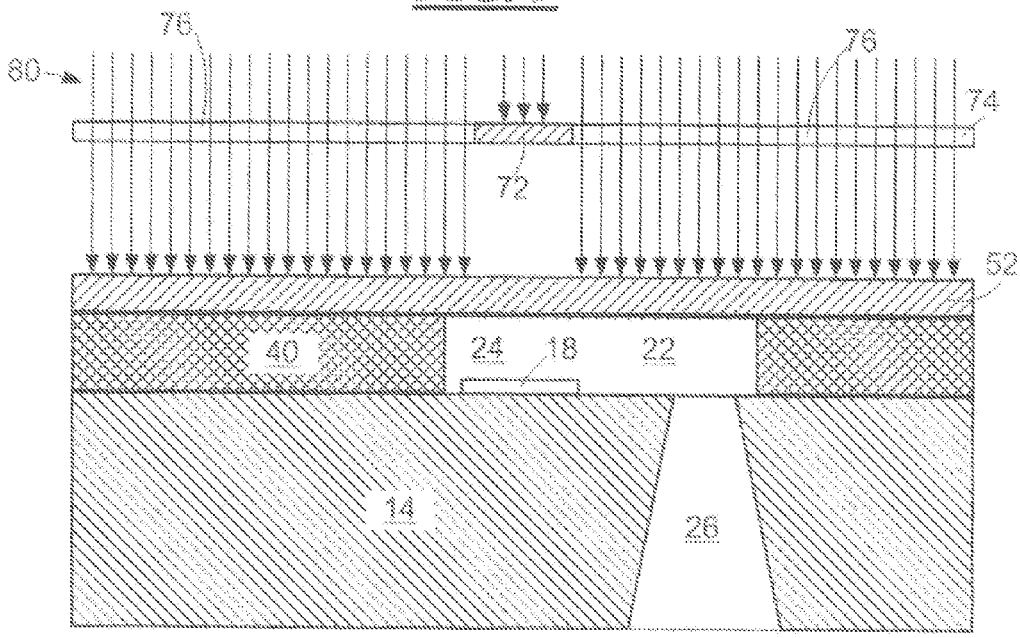

An alternate process for the stress relief step is illustrated in FIGS. 9 and 10 in which the layer 52 is exposed to UV radiation in 2 steps. In the alternative process, the release liner 56 is removed prior to exposing the layer 52 to the radiation and stress relieving steps. In a first step of the process, the bulk of the layer 52 is exposed to UV radiation, indicated by arrows 80, for a period of time sufficient to at least partially cure the layer 52 in order to prevent excess drooping of the layer 52 into the flow features of the layer 40. The UV radiation exposure time in the first step of the process may be conducted for 50 milliseconds to about 10 minutes.

In a second step of the process, after exposing the layer 52 to UV radiation, in order to complete the partial cure of the layer 52 and to relieve stress in the layer 52, the layer is post exposed to a baking temperature in the range of from about 50 to about 110° C. for a period of time ranging from about 1 minute to about 30 minutes. The layer is then exposed to UV radiation through a mask 60 to image layer 52 and the imaged areas are developed to provide the nozzles 20 as described above with references to FIG. 8. In order to conduct the process according to this alternative procedure, a UV radiation exclusion zone 68 (FIG. 9) around each of the future nozzle locations 70 in the layer 52 is defined by opaque areas 72 in a mask 74 (FIG. 10) while the remainder of the layer 52 is exposed to UV radiation through transparent areas 76 of the mask 74.

Figure 11:
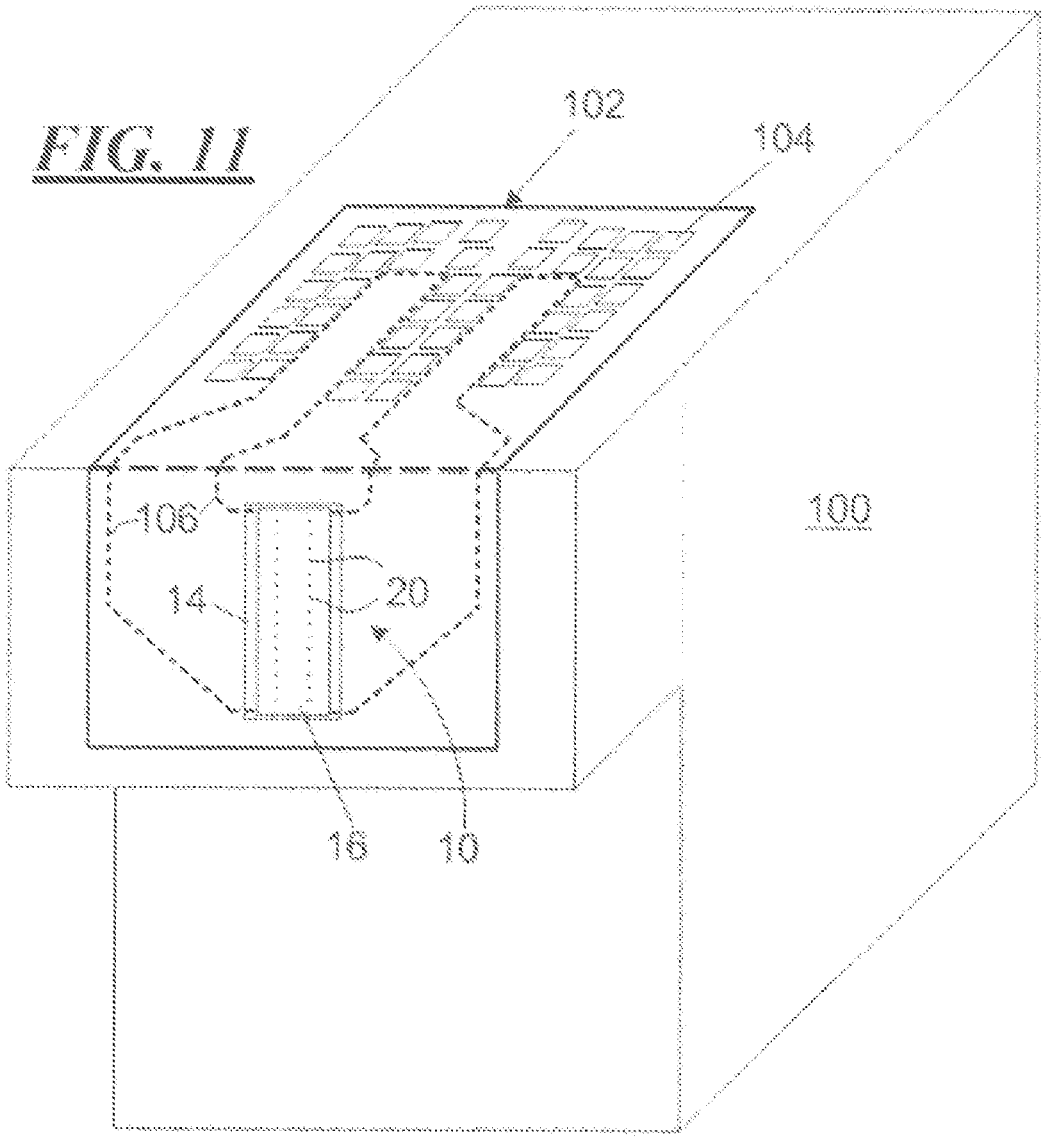
FIG. 11 is a perspective view, not to scale, of a fluid cartridge containing a micro-fluid ejection head according to the disclosure.
Figure 12:
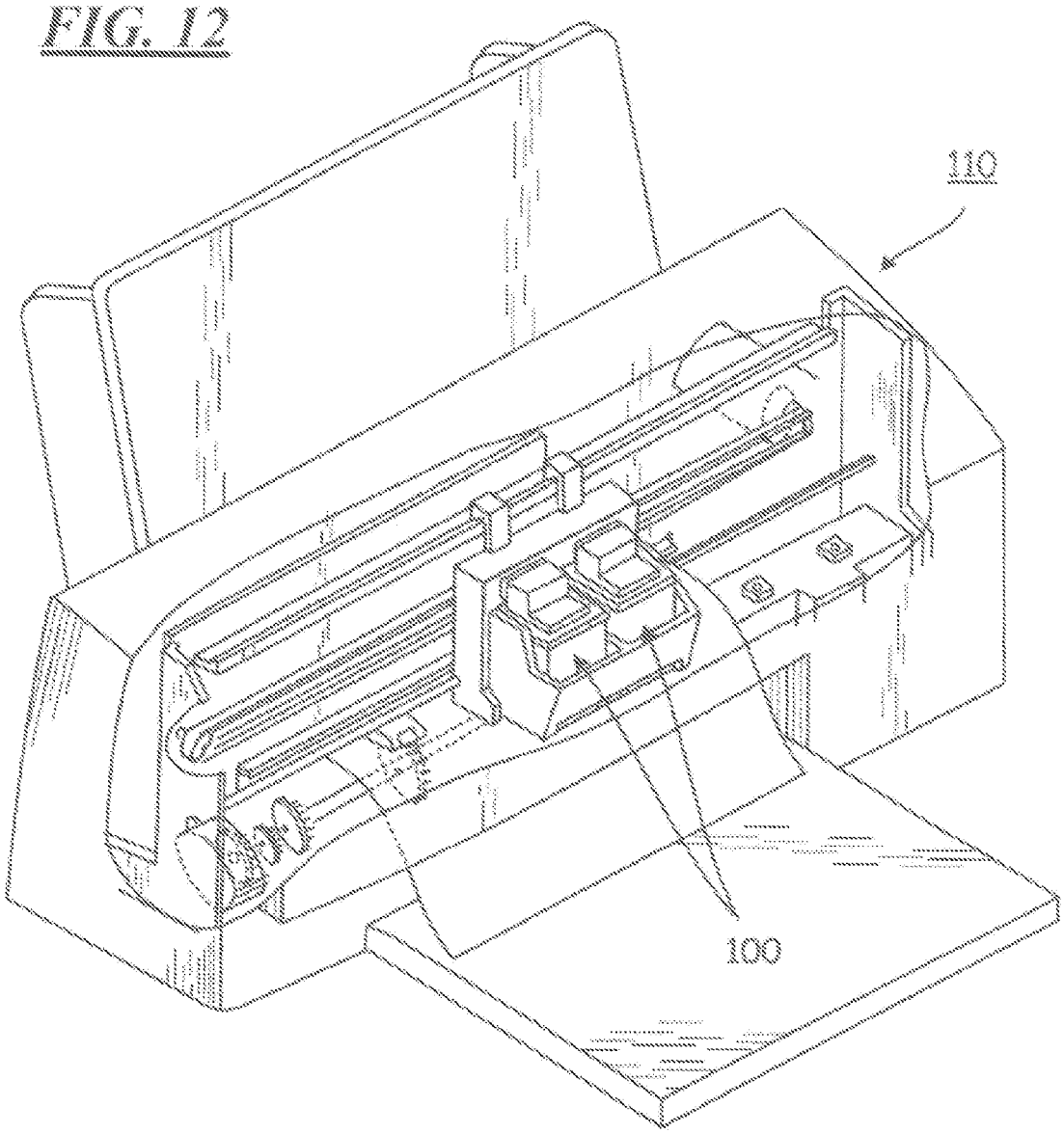
FIG. 12 is a perspective view, not to scale, of a micro-fluid ejection device for the fluid cartridge of claim 11.

The micro-fluid ejection head 10 made by the foregoing process may be attached to a fluid supply reservoir 100 as illustrated in FIG. 11. The fluid reservoir 100 includes a flexible circuit 102 containing electrical contacts 104 thereon for providing control and actuation of the fluid ejector actuators 18 on the substrate 14 via conductive traces 106. One or more reservoirs 100 containing the ejection heads 10 may be used in a micro-fluid ejection device 110, such as an ink jet printer as shown in FIG. 12 to provide control and ejection of fluid from the ejection heads 10.

Having described various aspects and exemplary embodiments and several advantages thereof, it will be recognized by those of ordinary skills that the disclosed embodiments is susceptible to various modifications, substitutions and revisions within the spirit and scope of the appended claims.

What is claimed is:

1. A method for making a micro-fluid ejection head, the method comprising the steps of:

applying a first photoresist layer to a device surface of a substrate containing fluid ejection actuators;

imaging a plurality of flow features in the first photoresist layer;

developing the imaged first photoresist layer to provide a thick film layer including the plurality of flow features therein;

applying a second photoresist layer to the thick film layer, the second photoresist layer having a thickness ranging from about 10 to about 30 microns;

applying a release liner to a surface of the second photoresist layer opposite to a surface attached to the thick film layer;

stress relieving the second photoresist layer;

removing the release liner from the second photoresist layer; and thereafter imaging a plurality of nozzle holes in the second photoresist layer; and developing the imaged second photoresist layer to provide a photoresist nozzle plate on the first photoresist layer.

2. The method of claim 1, wherein the first photoresist layer is spin coated onto the substrate.

3. The method of claim 2, wherein the first photoresist layer comprises a negative photoresist material.

4. The method of claim 1, wherein the second photoresist layer is laminated to the thick film layer.

5. The method of claim 4, wherein the second photoresist layer comprises a dry film photoresist material.

6. The method of claim 1, wherein the stress relieving step comprises heating the substrate containing the thick film layer and second photoresist layer to a temperature sufficient to relieve stress in the second photoresist layer without curing the second photoresist layer.

7. The method of claim 1, wherein second photoresist layer is applied to the thick film layer by laminating the second photoresist layer to the thick film layer as a dry film laminate.

8. A method for improving fluid ejection directionality from nozzles of a micro-fluid ejection head comprising:

applying a nozzle plate of a dry film photoresist material to a thick film layer containing flow features on a substrate that includes fluid ejection actuators;

heating the dry film photoresist material to a temperature sufficient to reduce stresses in the dry film photoresist material without curing the dry film photoresist material; and imaging and developing the nozzles in the dry film photoresist material, wherein the dry film photoresist material comprises a release liner, further comprising removing the release liner from the dry film photoresist material after the heating and prior to the imaging and developing the nozzles.

9. The method of claim 8, wherein the nozzles have a directionality axis for fluid ejection therefrom that is substantially perpendicular to a surface of the nozzle plate material.

* * * * *